US009746790B2

(12) United States Patent
Nishida et al.

(10) Patent No.: US 9,746,790 B2
(45) Date of Patent: Aug. 29, 2017

(54) ELECTROPHOTOGRAPHIC PHOTOSENSITIVE MEMBER, PROCESS CARTRIDGE AND ELECTROPHOTOGRAPHIC APPARATUS, AND CHLOROGALLIUM PHTHALOCYANINE CRYSTAL AND METHOD FOR PRODUCING THE SAME

(71) Applicant: CANON KABUSHIKI KAISHA, Tokyo (JP)

(72) Inventors: Tsutomu Nishida, Mishima (JP); Masato Tanaka, Tagata-gun (JP); Masataka Kawahara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/920,631

(22) Filed: Oct. 22, 2015

(65) Prior Publication Data

US 2016/0124329 A1 May 5, 2016

(30) Foreign Application Priority Data

Oct. 29, 2014 (JP) ..... 2014-220749

(51) Int. Cl.
*G03G 5/047* (2006.01)
*G03G 5/06* (2006.01)

(52) U.S. Cl.
CPC ..... *G03G 5/0696* (2013.01)

(58) Field of Classification Search
CPC ..... G03G 5/0696
See application file for complete search history.

(56) References Cited

U.S. PATENT DOCUMENTS

| | | | | |
|---|---|---|---|---|
| 5,759,726 | A * | 6/1998 | Tambo | C09B 47/067 430/59.4 |
| 2003/0013029 | A1* | 1/2003 | Burt | G03G 5/0696 430/59.4 |
| 2009/0068576 | A1 | 3/2009 | Hongo | |
| 2010/0196817 | A1* | 8/2010 | Sasaki | G03G 9/0819 430/109.4 |
| 2016/0124326 | A1* | 5/2016 | Nishida | G03G 5/047 399/111 |

FOREIGN PATENT DOCUMENTS

| | | | |
|---|---|---|---|
| JP | 05-194523 | A | 8/1993 |
| JP | 11-172143 | A | 6/1999 |
| JP | 2000-344778 | A | 12/2000 |
| JP | 2005-226013 | A | 8/2005 |
| JP | 2005-249964 | A | 9/2005 |
| JP | 2009-062475 | A | 3/2009 |

* cited by examiner

*Primary Examiner* — Peter Vajda
(74) *Attorney, Agent, or Firm* — Canon U.S.A., Inc. IP Division

(57) ABSTRACT

An electrophotographic photosensitive member includes a support and a photosensitive layer in this order. The photosensitive layer contains a chlorogallium phthalocyanine crystal represented by formula (1) in which at least one organic compound selected from N,N-dimethylformamide and dimethyl sulfoxide is contained. The content of the organic compound contained in the chlorogallium phthalocyanine crystal represented by the formula (1) is 0.10 mass % or more and 0.80 mass % or less based on a content of the chlorogallium phthalocyanine crystal represented by the formula (1).

5 Claims, 6 Drawing Sheets

ELECTROPHOTOGRAPHIC PHOTOSENSITIVE MEMBER, PROCESS CARTRIDGE AND ELECTROPHOTOGRAPHIC APPARATUS, AND CHLOROGALLIUM PHTHALOCYANINE CRYSTAL AND METHOD FOR PRODUCING THE SAME

BACKGROUND OF THE INVENTION

Field of the Invention

The present invention relates to an electrophotographic photosensitive member, a process cartridge and an electrophotographic apparatus that use the electrophotographic photosensitive member, and a chlorogallium phthalocyanine crystal and a method for producing the chlorogallium phthalocyanine crystal.

Description of the Related Art

Phthalocyanine pigments having an excellent function as a photoconductor are used as materials for electrophotographic photosensitive members, solar batteries, sensors, switching elements, and the like. Among the phthalocyanine pigments, chlorogallium phthalocyanine crystals are used, for example, as a charge generation material for electrophotographic photosensitive members. There have been studies in which various treatments are performed on the chlorogallium phthalocyanine crystals in accordance with the application (Japanese Patent Laid-Open No. 5-194523 and Japanese Patent Laid-Open No. 2005-226013).

Japanese Patent Laid-Open No. 5-194523 discloses a technique concerning a production method in which chlorogallium phthalocyanine crystals are treated with an aromatic alcohol. Japanese Patent Laid-Open No. 2005-226013 discloses a technique concerning a chlorogallium phthalocyanine pigment having a particular absorption spectrum.

SUMMARY OF THE INVENTION

An electrophotographic photosensitive member according to an aspect of the present invention includes a support and a photosensitive layer in this order. The photosensitive layer contains a chlorogallium phthalocyanine crystal represented by formula (1) in which at least one organic compound selected from N,N-dimethylformamide and dimethyl sulfoxide is contained. The content of the organic compound contained in the chlorogallium phthalocyanine crystal represented by the formula (1) is 0.10 mass % or more and 0.80 mass % or less based on the content of the chlorogallium phthalocyanine crystal represented by the formula (1).

(1)

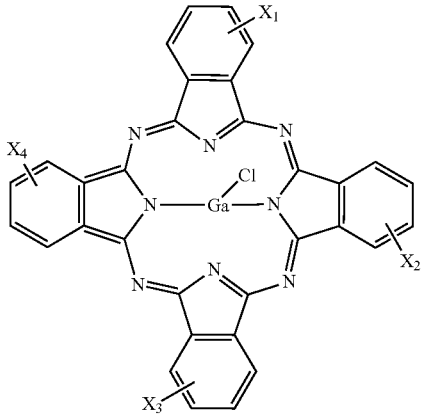

In the formula (1), $X_1$ to $X_4$ each independently represent a hydrogen atom or a chlorine atom.

Further features of the present invention will become apparent from the following description of exemplary embodiments with reference to the attached drawings.

DESCRIPTION OF THE EMBODIMENTS

Figure 1:
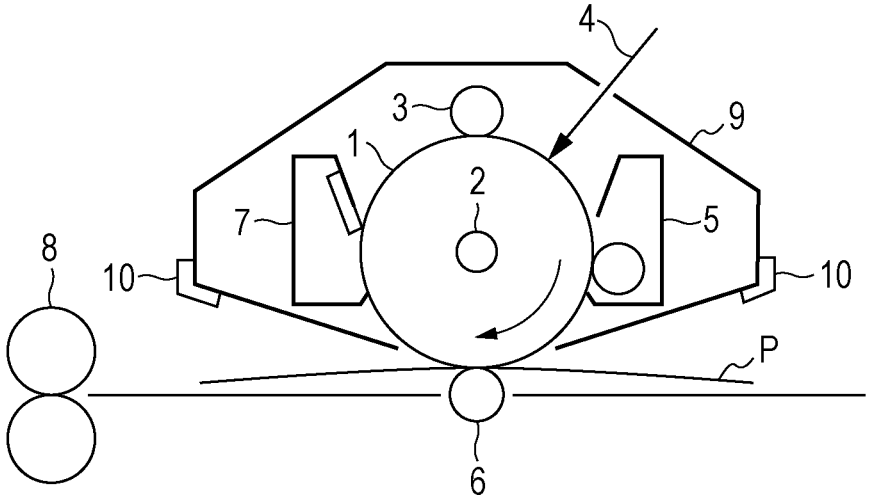
FIG. 1 illustrates an example of a schematic structure of an electrophotographic apparatus that includes a process cartridge including an electrophotographic photosensitive member.

As a result of studies conducted by the present inventors, the known electrophotographic photosensitive members disclosed in Japanese Patent Laid-Open No. 5-194523 and Japanese Patent Laid-Open No. 2005-226013 in which chlorogallium phthalocyanine crystals are used as a charge generation material exhibit high sensitivity, but generated charges sometimes remain in a photosensitive layer, which poses a problem in that ghosting occurs in an output image. The term "ghosting" refers to a phenomenon in which the image density of a portion irradiated with light during the previous rotation of an electrophotographic photosensitive member increases or decreases in an output image.

Accordingly, the present invention provides a chlorogallium phthalocyanine crystal that contributes to suppressing the occurrence of ghosting and a method for producing the chlorogallium phthalocyanine crystal, an electrophotographic photosensitive member in which the occurrence of ghosting is sufficiently suppressed by using the chlorogallium phthalocyanine crystal, and a process cartridge and an electrophotographic apparatus that use the electrophotographic photosensitive member.

The chlorogallium phthalocyanine crystal according to an embodiment of the present invention is a compound represented by formula (1) in which at least one organic compound selected from N,N-dimethylformamide and dimethyl sulfoxide is contained. Furthermore, the content of the organic compound contained in the chlorogallium phthalocyanine crystal represented by the formula (1) is 0.10 mass % or more and 0.80 mass % or less based on the content of the chlorogallium phthalocyanine crystal represented by the formula (1). The present inventors have found that the chlorogallium phthalocyanine pigment can contribute to suppressing the occurrence of ghosting.

(1)

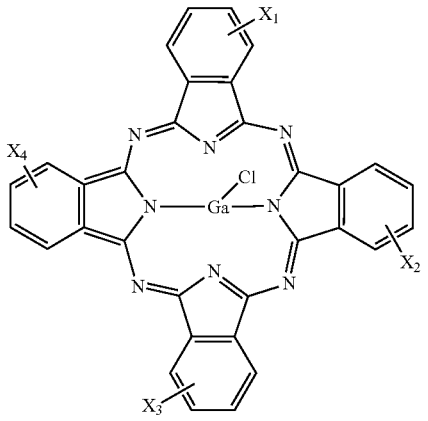

In the formula (1), $X_1$ to $X_4$ each independently represent a hydrogen atom or a chlorine atom.

It has been also found that the occurrence of ghosting can be sufficiently suppressed by adding the particular chlorogallium phthalocyanine crystal to a photosensitive layer (charge generating layer) of an electrophotographic photosensitive member. The present inventors assume that this is because when the chlorogallium phthalocyanine crystal has a structure represented by the formula (1) and a particular organic compound is contained in the crystal in a particular amount (0.10 mass % or more and 0.80 mass % or less), the movement of carriers (residual carriers) that remain in a photosensitive layer after irradiation with light, which is a cause of ghosting, is synergistically facilitated.

Chlorogallium Phthalocyanine Crystal Represented by Formula (1) and Containing Organic Compound In an embodiment of the present invention, the chlorogallium phthalocyanine crystal represented by the formula (1) is preferably a chlorogallium phthalocyanine crystal in which one of $X_1$ to $X_4$ in the formula (1) represents a chlorine atom and three of $X_1$ to $X_4$ represent hydrogen atoms or a chlorogallium phthalocyanine crystal in which all of $X_1$ to $X_4$ in the formula (1) represent hydrogen atoms. The chlorogallium phthalocyanine crystal represented by the formula (1) is more preferably a mixture of the chlorogallium phthalocyanine crystal in which all of $X_1$ to $X_4$ in the formula (1) represent hydrogen atoms and the chlorogallium phthalocyanine crystal in which one of $X_1$ to $X_4$ represents a chlorine atom and three of $X_1$ to $X_4$ represent hydrogen atoms. The crystal structure may be analyzed by mass spectrometry. In Examples described below, the crystal structure was analyzed by measuring the molecular weight using a mass spectrometer (MALDI-TOF MS: ultraflex manufactured by Bruker Daltonics K.K.) under the conditions of acceleration voltage: 20 kV, mode: Reflector, and molecular weight standard: fullerene $C_{60}$.

As described above, in an embodiment of the present invention, the content of the organic compound contained in the chlorogallium phthalocyanine crystal represented by the formula (1) (that is, based on the total content of the organic compound and the chlorogallium phthalocyanine crystal represented by the formula (1)) needs to be 0.10 mass % or more and 0.80 mass % or less based on the content of the chlorogallium phthalocyanine crystal represented by the formula (1). Furthermore, the content of the organic compound is preferably 0.40 mass % or more and 0.65 mass % or less based on the content of the chlorogallium phthalocyanine crystal represented by the formula (1) in order to suppress the occurrence of ghosting. If the content of the organic compound is less than 0.10 mass %, the movement of residual carriers is not sufficiently facilitated and thus ghosting is not sufficiently suppressed. If the content of the organic compound is more than 0.80 mass %, a phenomenon in which residual carriers are trapped in the organic compound occurs. Consequently, the movement of residual carriers is not sufficiently facilitated and thus ghosting is not sufficiently suppressed. In an embodiment of the present invention, the content of the organic compound can be determined by nuclear magnetic resonance spectroscopy (H-NMR). In Examples described below, the H-NMR measurement was performed using sulfuric acid-D2 ($D_2SO_4$) as a solvent and AVANCEIII 500 manufactured by BRUKER as a measurement instrument.

In an embodiment of the present invention, for example, the chlorogallium phthalocyanine crystal has peaks at 7.4°, 16.6°, 25.5°, and 28.4° in a CuKα X-ray diffraction pattern (Bragg angles 2θ±0.2°). In particular, for example, the chlorogallium phthalocyanine crystal has four major peaks at the above four angles. Herein, the term "four major peaks" refers to peaks from a peak having the highest intensity to a peak having the fourth highest intensity in the X-ray diffraction pattern. When such a crystal is used, ghosting is further suppressed. In an embodiment of the present invention, the X-ray diffraction of the phthalocyanine crystal is measured by powder X-ray diffractometry under the following conditions.

Measurement instrument used: X-ray diffractometer RINT-TTR II manufactured by Rigaku Corporation
X-ray tube: Cu
Tube voltage: 50 kV
Tube current: 300 mA
Scanning mode: 2θ/θ scan
Scanning speed: 4.0°/min
Sampling step size: 0.02°
Start angle (2θ): 5.0°
Stop angle (2θ): 40.0°
Attachment: standard sample holder
Filter: nonuse
Incidence monochromator: use
Counter monochromator: nonuse
Divergence slit: open
Divergence vertical limitation slit: 10.00 mm
Scattering slit: open
Receiving slit: open
Counter: scintillation counter Production Method In an embodiment of the present invention, the chlorogallium phthalocyanine crystal represented by the formula (1) in which at least one organic compound selected from N,N-dimethylformamide and dimethyl sulfoxide is contained is obtained, for example, through (1) a synthesis step, (2) an acid pasting step, (3) a hydrochloric acid treatment step, and (4) a wet milling step. In particular, the chlorogallium phthalocyanine crystal is desirably obtained through (2) the acid pasting step.

(1) Synthesis Step

The synthesis step is a step of synthesizing a chlorogallium phthalocyanine crystal by reacting a gallium compound and a compound that forms a phthalocyanine ring in a chlorinating aromatic compound. The gallium compound is, for example, gallium trichloride. Furthermore, the compound that forms a phthalocyanine ring is, for example, orthophthalonitrile and the chlorinating aromatic compound is, for example, α-chloronaphthalene.

(2) Acid Pasting Step

The acid pasting step is a step of obtaining a hydroxygallium phthalocyanine crystal by performing an acid pasting treatment in which the chlorogallium phthalocyanine crystal obtained in the synthesis step is mixed with an acid. The acid used in the acid pasting step is preferably sulfuric acid and more preferably concentrated sulfuric acid.

(3) Hydrochloric Acid Treatment Step

The hydrochloric acid treatment step is a step of obtaining a chlorogallium phthalocyanine crystal by mixing the hydroxygallium phthalocyanine crystal obtained in the acid pasting step with an aqueous hydrochloric acid solution.

In the hydrochloric acid treatment step, the concentration of the aqueous hydrochloric acid solution mixed with the hydroxygallium phthalocyanine crystal is preferably 10 mass % or more and more preferably 30 mass % or more in view of reactivity.

In the hydrochloric acid treatment step, the amount of hydrochloric acid mixed with the hydroxygallium phthalocyanine crystal is preferably 10 mol or more and more preferably 100 mol or more based on 1 mol of the hydroxygallium phthalocyanine crystal used.

(4) Wet Milling Step

The wet milling step is a step of mixing the chlorogallium phthalocyanine crystal obtained in the hydrochloric acid treatment step with at least one organic compound selected from N,N-dimethylformamide and dimethyl sulfoxide and performing a wet milling treatment. The organic compound is taken into the chlorogallium phthalocyanine crystal in the wet milling step, and thus a chlorogallium phthalocyanine crystal containing the organic compound can be obtained. The content of the organic compound contained in the chlorogallium phthalocyanine crystal represented by the formula (1) can be controlled by changing the treatment conditions of the chlorogallium phthalocyanine crystal before the wet milling step and the wet milling treatment conditions. In the wet milling step, the amount of the organic compound used is, for example, 5 to 30 times the amount of the chlorogallium phthalocyanine crystal used on a mass basis. In an embodiment of the present invention, the "wet milling treatment" is a treatment performed using a milling apparatus such as a sand mill, a ball mill, or a paint shaker or a stirring apparatus such as a homogenizer, a mixing impeller, or a magnetic stirrer. The milling treatment time is, for example, 1 to 100 hours.

Next, the case where the above-described chlorogallium phthalocyanine crystal according to an embodiment of the present invention is used as a charge generation material for an electrophotographic photosensitive member will be described.

Electrophotographic Photosensitive Member

An electrophotographic photosensitive member according to an embodiment of the present invention includes a support and a photosensitive layer. The photosensitive layer may be a single-layer type photosensitive layer containing both a charge transport material and a charge generation material or a multilayer type (function-separated) photosensitive layer separately including a charge generating layer containing a charge generation material and a charge transporting layer containing a charge transport material. In view of electrophotographic characteristics, an electrophotographic photosensitive member including a support, a charge generating layer, and a charge transporting layer in this order is particularly used.

Figure 2A:
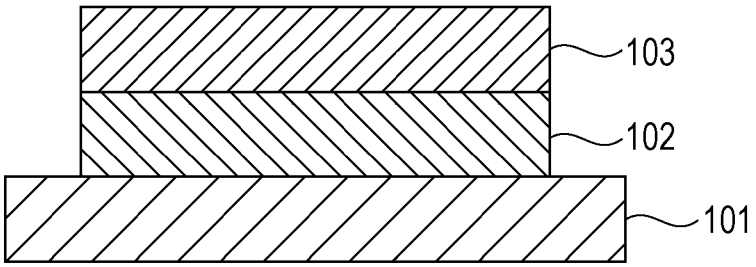
FIGS. 2A and 2B illustrate examples of layer structures of an electrophotographic photosensitive member.
Figure 2B:
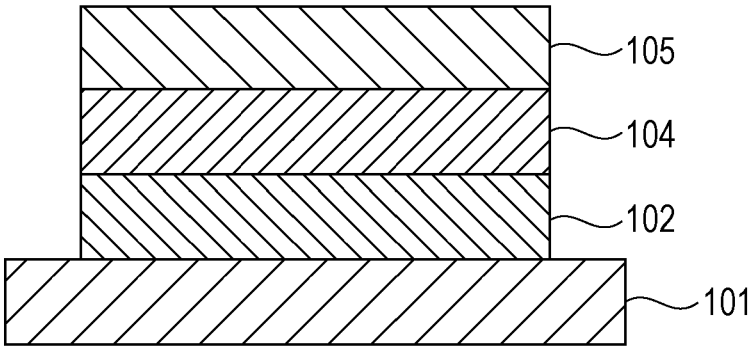

FIGS. 2A and 2B illustrate examples of layer structures of the electrophotographic photosensitive member. FIG. 2A illustrates a single-layer type photosensitive layer in which an undercoat layer 102 is formed on a support 101 and a photosensitive layer 103 is formed on the undercoat layer 102. FIG. 2B illustrates a multilayer type photosensitive layer in which an undercoat layer 102 is formed on a support 101, a charge generating layer 104 is formed on the undercoat layer 102, and a charge transporting layer 105 is formed on the charge generating layer 104.

Support

The support is, for example, a conductive support having electrical conductivity. The support may be, for example, a support made of a metal or an alloy such as aluminum or stainless steel. The support may also be a metal support, a plastic support, or a paper support whose surface is coated with a conductive film. The shape of the support is, for example, a cylindrical shape or a film-like shape.

An undercoat layer or a conductive layer may be disposed between the support and the photosensitive layer.

Conductive Layer

A conductive layer may be disposed between the support and an undercoat layer described below in order to cover unevenness on the surface of the support and suppress interference fringes. The conductive layer can be formed by forming a coating film of a conductive layer-forming coating liquid prepared by dispersing conductive particles, a binder resin, and a solvent and then drying the coating film. The thickness of the conductive layer is preferably 5 to 40 μm and more preferably 10 to 30 μm.

Examples of the conductive particles used in the conductive layer include aluminum particles, titanium oxide particles, tin oxide particles, zinc oxide particles, carbon black, and silver particles. Examples of the binder resin include polyester, polycarbonate, polyvinyl butyral, acrylic resin, silicone resin, epoxy resin, melamine resin, urethane resin, phenolic resin, and alkyd resin. Examples of the solvent for the conductive layer-forming coating liquid include ether solvents, alcohol solvents, ketone solvents, and aromatic hydrocarbon solvents.

Undercoat Layer

An undercoat layer (also referred to as an intermediate layer) having a barrier function and an adhesive function may also be disposed so as to be adjacent to the surface of the photosensitive layer on the support side. The undercoat layer can be formed by forming a coating film of an undercoat layer-forming coating solution prepared by mixing a binder resin and a solvent and drying the coating film. The thickness of the undercoat layer is preferably 0.1 to 10 μm and more preferably 0.3 to 5.0 μm.

Examples of the binder resin used in the undercoat layer include polyvinyl alcohol, polyethylene oxide, ethyl cellulose, methyl cellulose, casein, polyamide, glue, and gelatin.

Photosensitive Layer (1) Single-Layer Type Photosensitive Layer

When the photosensitive layer is a single-layer type photosensitive layer, the photosensitive layer contains the chlorogallium phthalocyanine crystal according to an embodiment of the present invention as a charge generation material. The photosensitive layer can be formed by forming a coating film of a photosensitive layer-forming coating solution prepared by mixing the chlorogallium phthalocyanine crystal according to an embodiment of the present invention, a charge transport material, and a binder resin in a solvent and drying the coating film. The charge transport material and the binder resin are the same as those exemplified in "(2) Multilayer type photosensitive layer" described below.

(2) Multilayer Type Photosensitive Layer

When the photosensitive layer is a multilayer type photosensitive layer, the photosensitive layer includes a charge generating layer and a charge transporting layer.

(2-1) Charge Generating Layer

The charge generating layer contains the chlorogallium phthalocyanine crystal according to an embodiment of the present invention as a charge generation material. The charge generating layer can be formed by forming a coating film of a charge generating layer-forming coating solution prepared by mixing the chlorogallium phthalocyanine crystal and a binder resin in a solvent and then drying the coating film. The thickness of the charge generating layer is preferably 0.05 to 1 μm and more preferably 0.1 to 0.3 μm.

The content of the charge generation material in the charge generating layer is preferably 30 mass % or more and 90 mass % or less and more preferably 50 mass % or more and 80 mass % or less based on the total mass of the charge generating layer.

Materials other than the chlorogallium phthalocyanine crystal according to an embodiment of the present invention may also be used in combination as the charge generation material. In this case, the content of the chlorogallium phthalocyanine crystal according to an embodiment of the present invention is preferably 50 mass % or more based on the total mass of the charge generation material.

Examples of the binder resin used for the charge generating layer include polyester, acrylic resin, phenoxy resin, polycarbonate, polyvinyl butyral, polystyrene, polyvinyl acetate, polysulfone, polyarylate, vinylidene chloride, acrylonitrile copolymers, and polyvinyl benzal. Among them, polyvinyl butyral and polyvinyl benzal are particularly used.

(2-2) Charge Transporting Layer

The charge transporting layer can be formed by forming a coating film of a charge transporting layer-forming coating solution prepared by dissolving a charge transport material and a binder resin in a solvent and drying the coating film. The thickness of the charge transporting layer is preferably 5 to 40 μm and more preferably 10 to 25 μm.

Examples of the charge transport material include triarylamine compounds, hydrazone compounds, stilbene compounds, pyrazoline compounds, oxazole compounds, thiazole compounds, and triallylmethane compounds. Among them, a triarylamine compound is particularly used.

Examples of the binder resin used for the charge transporting layer include polyester, acrylic resin, phenoxy resin, polycarbonate, polystyrene, polyvinyl acetate, polysulfone, polyarylate, vinylidene chloride, and acrylonitrile copolymers. Among them, polycarbonate and polyarylate are particularly used.

The content of the charge transport material in the charge transporting layer is preferably 20 mass % or more and 80 mass % or less and more preferably 30 mass % or more and 60 mass % or less based on the total mass of the charge transporting layer.

Protective Layer

A protective layer may be disposed on a surface of the photosensitive layer, the surface being located opposite the support, in order to protect the photosensitive layer. The protective layer can be formed by forming a coating film of a protective layer-forming coating solution prepared by dissolving a binder resin in a solvent and drying the coating film. Examples of the binder resin used for the protective layer include polyvinyl butyral, polyester, polycarbonate, nylon, polyimide, polyarylate, polyurethane, styrene-butadiene copolymers, styrene-acrylic acid copolymers, and styrene-acrylonitrile copolymers. The thickness of the protective layer is, for example, 0.05 to 20 μm.

To provide charge transportability to the protective layer, the protective layer may be formed by curing a monomer having charge transportability (hole transportability) through a polymerization reaction or a cross-linking reaction. Specifically, the protective layer can be formed by curing a charge transporting compound (hole transporting compound) having a chain-polymerizable functional group through polymerization or cross-linking.

Examples of a method for applying the coating solutions for the above-described layers include dipping, spray coating, spinner coating, bead coating, blade coating, and beam coating.

Surface Layer

The surface layer of the electrophotographic photosensitive member may contain conductive particles, an ultraviolet absorber, and lubricant particles such as fluorine-containing resin particles. The conductive particles are, for example, metal oxide particles such as tin oxide particles.

Process Cartridge and Electrophotographic Apparatus

A process cartridge according to an embodiment of the present invention integrally supports the above-described electrophotographic photosensitive member and at least one selected from a charging device, a developing device, a transfer device, and a cleaning member and is detachably attachable to a main body of an electrophotographic apparatus.

An electrophotographic apparatus according to an embodiment of the present invention includes the above-described electrophotographic photosensitive member, a charging device, an exposure device, a developing device, and a transfer device.

FIG. 1 illustrates an example of a schematic structure of an electrophotographic apparatus that includes a process cartridge including an electrophotographic photosensitive member.

A cylindrical (drum-shaped) electrophotographic photosensitive member 1 is rotated about a shaft 2 at a predetermined peripheral speed (process speed) in a direction indicated by an arrow.

In the rotation, the surface (peripheral surface) of the electrophotographic photosensitive member 1 is charged at a predetermined positive or negative potential by a charging device (primary charging device) 3. The surface of the electrophotographic photosensitive member 1 is then irradiated with exposure light (image exposure light) 4 emitted from an exposure device (image exposure device, not illustrated). Thus, an electrostatic latent image corresponding to intended image information is formed on the surface of the electrophotographic photosensitive member 1. The exposure light 4 is, for example, intensity-modulated light emitted from an exposure device such as a slit exposure device or a laser beam scanning exposure device, in response to the time-series electric digital image signals of the intended image information.

The electrostatic latent image formed on the surface of the electrophotographic photosensitive member 1 is subjected to development (normal or reversal development) with a developing agent (toner) contained in a developing device 5, and thus a toner image is formed on the surface of the electrophotographic photosensitive member 1. The toner image formed on the surface of the electrophotographic photosensitive member 1 is transferred onto a transfer material P by a transfer device 6. Herein, a voltage (transfer bias) having polarity opposite to the polarity of the electric charge of the toner is applied to the transfer device 6 from a bias power supply (not illustrated). The transfer material P is fed to a portion between the electrophotographic photosensitive member 1 and the transfer device 6 from a transfer material feeding device (not illustrated) in synchronism with the rotation of the electrophotographic photosensitive member 1.

The transfer material P onto which the toner image has been transferred is separated from the surface of the electrophotographic photosensitive member 1 and is conveyed to a fixing device 8. After the toner image is fixed, the transfer material P is output from the electrophotographic apparatus as an image-formed article (a print or a copy).

The surface of the electrophotographic photosensitive member 1 after the toner image has been transferred onto the transfer material P is cleaned by removing deposits such as a residual developing agent (residual toner) with a cleaning member 7. Such a residual toner can also be collected by a developing device or the like (cleanerless system).

Furthermore, the surface of the electrophotographic photosensitive member 1 is irradiated with pre-exposure light (not illustrated) from a pre-exposure device (not illustrated) to remove electricity, and then the electrophotographic photosensitive member 1 is repeatedly used for image forming. In the case where the charging device 3 is a contact charging device that uses a charging roller or the like as illustrated in FIG. 1, the pre-exposure device is not necessarily required.

A plurality of components selected from the components such as the electrophotographic photosensitive member 1, the charging device 3, the developing device 5, the transfer device 6, and the cleaning member 7 may be incorporated in a container and integrally supported to provide a process cartridge. The process cartridge may be detachably attachable to the main body of an electrophotographic apparatus. For example, the electrophotographic photosensitive member 1 and at least one selected from the charging device 3, the developing device 5, the transfer device 6, and the cleaning member 7 are integrally supported to provide a process cartridge 9, which is detachably attachable to the main body of an electrophotographic apparatus using a guide unit 10 such as a rail of the main body.

In the case where the electrophotographic apparatus is a copying machine or a printer, the exposure light 4 may be reflected light from a document or transmitted light. Alternatively, the exposure light 4 may be light applied by, for example, scanning with a laser beam according to signals into which a document read by a sensor is converted, driving of an LED array, or driving of a liquid-crystal shutter array.

EXAMPLES

Hereafter, the present invention will be further described in detail based on specific examples, but is not limited thereto. "Part" used below means "part by mass". The thickness of each layer of electrophotographic photosensitive members in Examples and Comparative Examples was determined by using an eddy current thickness meter (Fischerscope, manufactured by Fischer Instruments) or by conversion from the mass per unit area using specific gravity.

Synthesis Example 1

After 36.7 parts of orthophthalonitrile, 25 parts of gallium trichloride, and 300 parts of α-chloronaphthalene were reacted with each other in a nitrogen atmosphere at 200° C. for 5.5 hours, the resulting product was filtered at 130° C. The product was washed by dispersion using N,N-dimethylformamide at 140° C. for 2 hours and then filtered. The filter residue was washed with methanol and dried to obtain 46 parts of chlorogallium phthalocyanine. The chlorogallium phthalocyanine was a crystal having peaks at 7.4°, 16.6°, 25.5°, and 28.3° in a CuKα X-ray diffraction pattern (Bragg angle 2θ).

Synthesis Example 2

After 30 parts of 1,3-diiminoisoindoline, 8 parts of gallium trichloride, and 230 parts of dimethylsulfoxide were reacted with each other in a nitrogen atmosphere at 160° C. for 6 hours, the resulting product was filtered at 130° C. The product was washed by dispersion using N,N-dimethylformamide at 140° C. for 2 hours and then filtered. The filter residue was washed with methanol and dried to obtain 28 parts of chlorogallium phthalocyanine. The chlorogallium phthalocyanine was a crystal having a peak at 27.1° in a CuKα X-ray diffraction pattern (Bragg angle 2θ).

Synthesis Example 3

By a method described in Synthesis Example 1 of Japanese Patent Laid-Open No. 9-258466, 2,3,6,7,10,11,14,15-octachloro-chlorogallium phthalocyanine was synthesized.

Example 1

Acid Pasting Step

Figure 3:
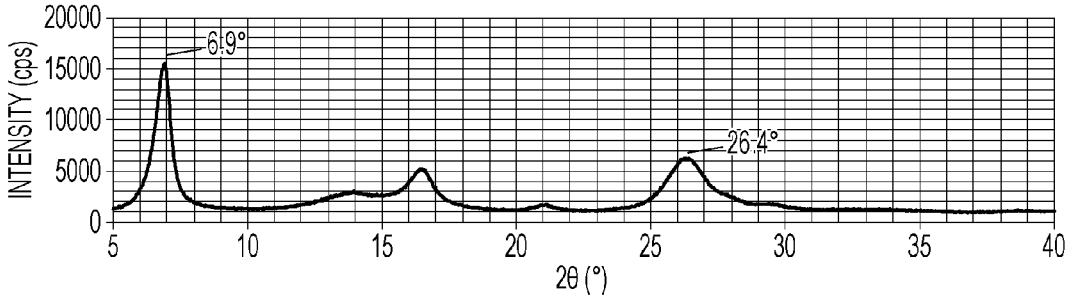
FIG. 3 illustrates an X-ray diffraction pattern of a hydroxygallium phthalocyanine crystal obtained in an acid pasting step in Example 1.

Twenty-four parts of the chlorogallium phthalocyanine obtained in Synthesis Example 1 was dissolved in 750 parts of concentrated sulfuric acid at 5° C. The mixture was dropped into 2500 parts of ice water under stirring to perform reprecipitation, and filtration was performed under reduced pressure. Herein, No. 5C (manufactured by ADVANTEC Co., Ltd.) was used as the filter. Subsequently, the filter residue was washed by dispersion using 2% ammonia water for 30 minutes, and then washed by dispersion using ion-exchanged water four times. Finally, freeze drying was performed and thus a hydroxygallium phthalocyanine crystal was obtained at a yield of 97%. The hydroxygallium phthalocyanine crystal was a crystal having peaks at 6.9° and 26.4° in a CuKα X-ray diffraction pattern (Bragg angle 2θ). FIG. 3 illustrates the measurement result (X-ray diffraction pattern) of the crystal form.

Hydrochloric Acid Treatment Step

Figure 4:
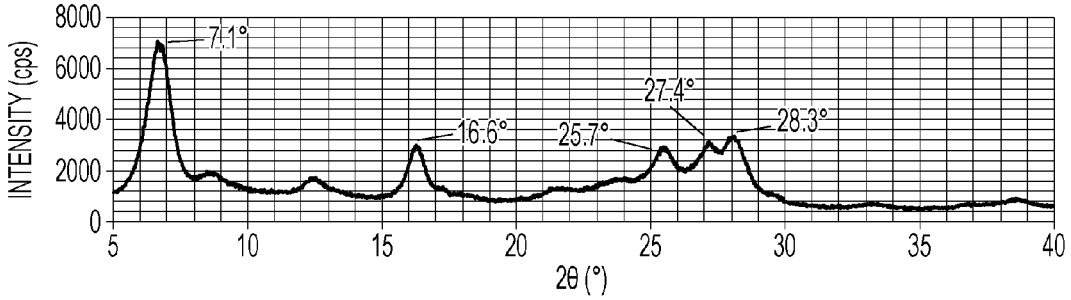
FIG. 4 illustrates an X-ray diffraction pattern of a chlorogallium phthalocyanine crystal obtained in a hydrochloric acid treatment step in Example 1.

Ten parts of the hydroxygallium phthalocyanine crystal obtained in the acid pasting step and 200 parts of an aqueous hydrochloric acid solution at 23° C. with a concentration of 35 mass % were mixed with each other and stirred using a magnetic stirrer for 90 minutes. The aqueous hydrochloric acid solution added contained 118 mol of hydrochloric acid based on 1 mol of the hydroxygallium phthalocyanine. After the stirring, the mixture was dropped into 1000 parts of ion-exchanged water cooled with ice water, and stirred using a magnetic stirrer for 30 minutes. Filtration was performed under reduced pressure. Herein, No. 5C (manufactured by ADVANTEC Co., Ltd.) was used as the filter. Subsequently, the filter residue was washed by dispersion using ion-exchanged water at 23° C. four times. Thus, 9 parts of a chlorogallium phthalocyanine crystal was obtained. The chlorogallium phthalocyanine crystal was a crystal having peaks at 7.1°, 16.6°, 25.7°, 27.4°, and 28.3° in a CuKα X-ray diffraction pattern (Bragg angle 2θ). FIG. 4 illustrates the measurement result (X-ray diffraction pattern) of the crystal form.

Wet Milling Step

Figure 5:
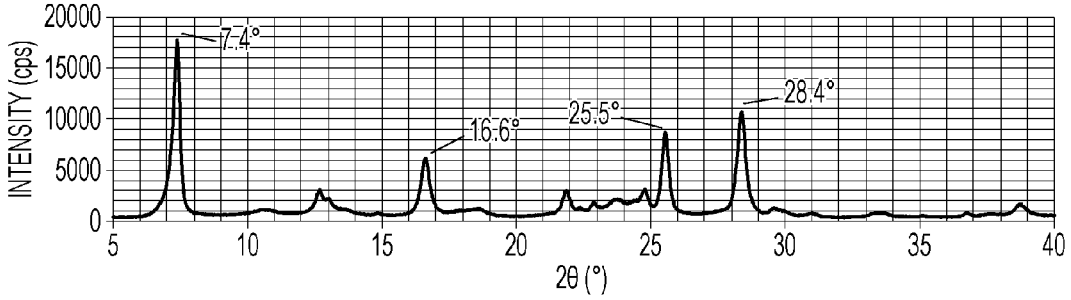
FIG. 5 illustrates an X-ray diffraction pattern of a chlorogallium phthalocyanine crystal obtained in a wet milling step in Example 1.

At room temperature (23° C.), 0.5 parts of the chlorogallium phthalocyanine crystal obtained in the hydrochloric acid treatment step, 10 parts of N,N-dimethylformamide, and 15 parts of glass beads having a diameter of 1 mm were subjected to a milling treatment for 4 hours using a ball mill. A chlorogallium phthalocyanine crystal was extracted from the resulting dispersion liquid using tetrahydrofuran and filtered, and the resulting filter residue on the filter was thoroughly washed using tetrahydrofuran. The filter residue was vacuum-dried to obtain 0.43 parts of a chlorogallium phthalocyanine crystal. The chlorogallium phthalocyanine crystal was a crystal having peaks at 7.4°, 16.6°, 25.5°, and 28.4° in a CuKα X-ray diffraction pattern (Bragg angle 2θ). FIG. 5 illustrates the measurement result (X-ray diffraction pattern) of the crystal form.

It was confirmed from the H-NMR measurement that the content of the N,N-dimethylformamide was 0.59 mass % based on the chlorogallium phthalocyanine in the chlorogallium phthalocyanine crystal in terms of proton ratio.

Step of Producing Electrophotographic Photosensitive Member

An aluminum cylinder (JIS-A3003, aluminum alloy) having a diameter of 24 mm and a length of 257.5 mm was used as a support (conductive support).

First, 60 parts of barium sulfate particles coated with tin oxide (trade name: Passtran PC1, manufactured by MITSUI MINING & SMELTING Co., Ltd.), 15 parts of titanium oxide particles (trade name: TITANIX JR, manufactured by TAYCA CORPORATION), 43 parts of resole phenolic resin (trade name: Phenolite J-325, manufactured by DIC Corporation, solid content: 70 mass %), 0.015 parts of silicone oil (trade name: SH28PA, manufactured by Dow Corning Toray Co., Ltd.), 3.6 parts of silicone resin particles (trade name: Tospearl 120, manufactured by Toshiba Silicone Co., Ltd.), 50 parts of 2-methoxy-1-propanol, and 50 parts of methanol were inserted into a ball mill and dispersed for 20 hours to prepare a conductive layer-forming coating liquid. The conductive layer-forming coating liquid was applied onto the support by dipping to form a coating film. The coating film was cured by performing heating at 140° C. for 1 hour to form a conductive layer having a thickness of 15 μm.

Subsequently, 10 parts of copolymer nylon (trade name: Amilan CM8000, manufactured by Toray Industries, Inc.) and 30 parts of methoxymethylated 6 nylon (trade name: Toresin EF-30T, manufactured by Teikoku Chemical Industries Co., Ltd.) were dissolved in a mixed solvent of methanol 400 parts/n-butanol 200 parts to prepare an undercoat layer-forming coating solution. The undercoat layer-forming coating solution was applied onto the conductive layer by dipping to form a coating film. The coating film was dried at 80° C. for 6 minutes to form an undercoat layer having a thickness of 0.42 μm.

Subsequently, 2 parts of the chlorogallium phthalocyanine crystal (charge generation material) obtained in the wet milling step, 1 part of polyvinyl butyral (trade name: S-LEC BX-1, manufactured by SEKISUI CHEMICAL CO., LTD.), and 52 parts of cyclohexanone were inserted into a sand mill that uses glass beads having a diameter of 1 mm and dispersed for 6 hours. Then, 75 parts of ethyl acetate was added thereto to prepare a charge generating layer-forming coating solution. The charge generating layer-forming coating solution was applied onto the undercoat layer by dipping to form a coating film. The coating film was dried at 100° C. for 10 minutes to form a charge generating layer having a thickness of 0.20 μm.

Subsequently, 28 parts of a compound represented by formula (C-1) below (charge transport material (hole transport compound)), (C-1)

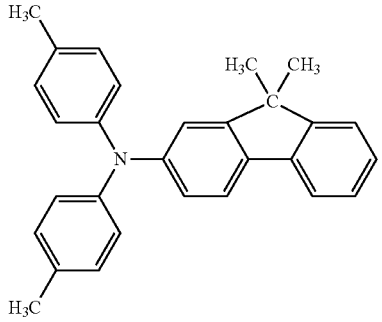

4 parts of a compound represented by formula (C-2) below (charge transport material (hole transport compound)), and (C-2)

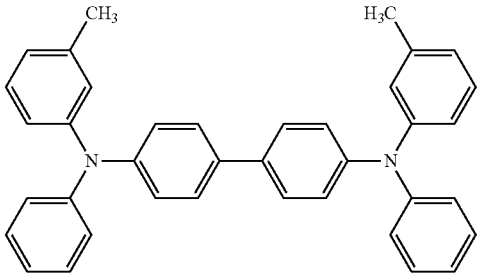

40 parts of polycarbonate (trade name: Iupilon Z200, manufactured by Mitsubishi Engineering-Plastics Corporation) were dissolved in a mixed solvent of monochlorobenzene 200 parts/dimethoxymethane 50 parts to prepare a charge transporting layer-forming coating solution. The charge transporting layer-forming coating solution was applied onto the charge generating layer by dipping to form a coating film. The coating film was dried at 120° C. for 30 minutes to form a charge transporting layer having a thickness of 18 μm.

Thus, a cylindrical (drum-shaped) electrophotographic photosensitive member of Example 1 was produced.

Example 2

An electrophotographic photosensitive member was produced in the same manner as in Example 1, except that 10 parts of the N,N-dimethylformamide used in the wet milling step was changed to 10 parts of dimethyl sulfoxide.

Example 3

Figure 6:
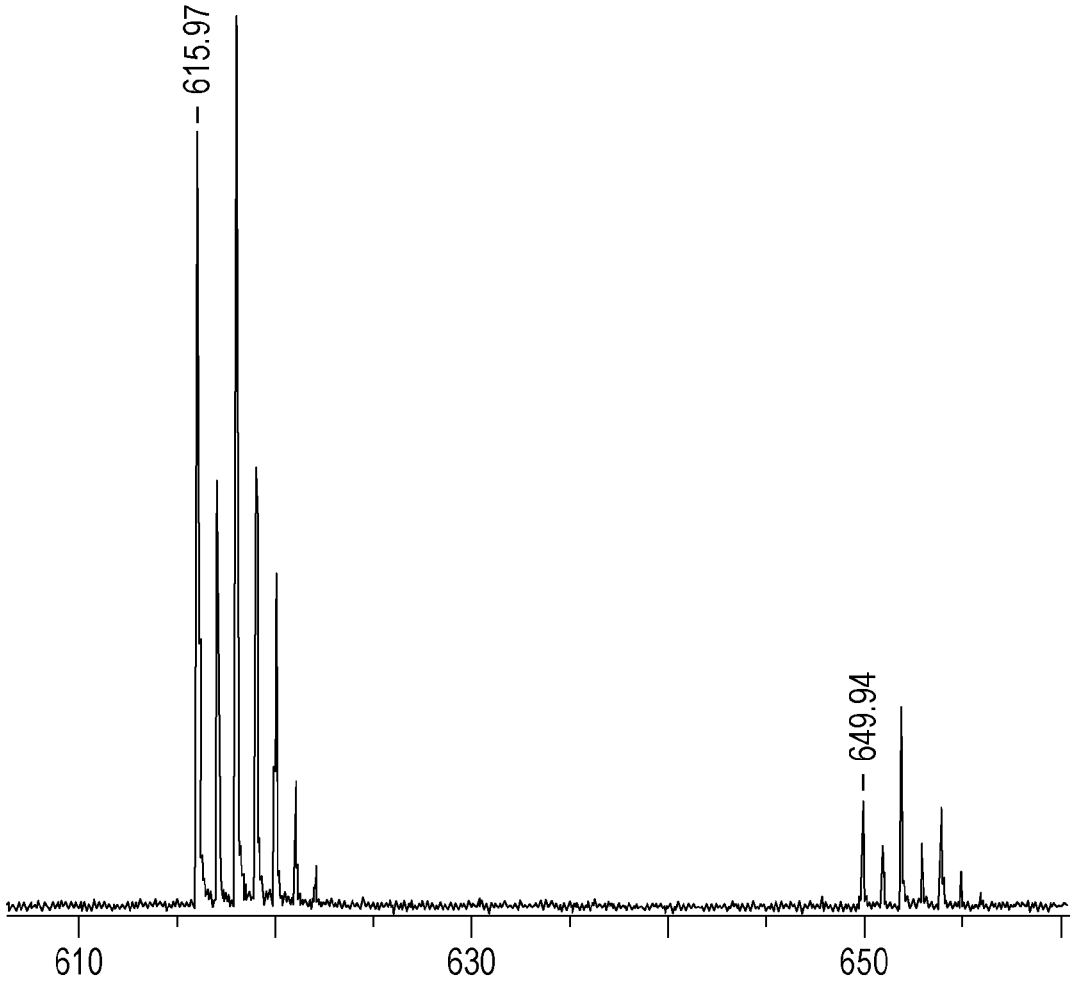
FIG. 6 illustrates the result of mass spectrometry of a chlorogallium phthalocyanine crystal obtained in a wet milling step in Example 3.

An electrophotographic photosensitive member was produced in the same manner as in Example 1, except that the treatment time of the wet milling step was changed to 24 hours. The molecular weight of the chlorogallium phthalocyanine crystal after the wet milling step was measured using a mass spectrometer, and FIG. 6 illustrates the result. It is found from the result that the chlorogallium phthalocyanine crystal is a mixture of a chlorogallium phthalocyanine (molecular weight: 616) in which all of $X_1$ to $X_4$ in the formula (1) represent hydrogen atoms and a chlorogallium phthalocyanine (molecular weight: 650) in which one of $X_1$ to $X_4$ in the formula (1) represents a chlorine atom.

Example 4

An electrophotographic photosensitive member was produced in the same manner as in Example 3, except that 10 parts of the N,N-dimethylformamide used in the wet milling step was changed to 10 parts of dimethyl sulfoxide.

Example 5

An electrophotographic photosensitive member was produced in the same manner as in Example 3, except that the chlorogallium phthalocyanine produced in Synthesis Example 1 and used in the acid pasting step was changed to the chlorogallium phthalocyanine produced in Synthesis Example 2.

Example 6

An electrophotographic photosensitive member was produced in the same manner as in Example 5, except that the treatment time of the wet milling step was changed to 500 hours.

Example 7

An electrophotographic photosensitive member was produced in the same manner as in Example 6, except that 10 parts of the N,N-dimethylformamide used in the wet milling step was changed to 10 parts of dimethyl sulfoxide.

Example 8

At room temperature (23° C.), 0.5 parts of the chlorogallium phthalocyanine obtained in Synthesis Example 1 and 15 parts of glass beads having a diameter of 1 mm were subjected to a milling treatment using a paint shaker for 24 hours to obtain a fine chlorogallium phthalocyanine crystal. An electrophotographic photosensitive member of Example 8 was produced in the same manner as in the wet milling step and the step of producing an electrophotographic photosensitive member in Example 1, except that the wet milling step was performed for 1000 hours using the resulting chlorogallium phthalocyanine crystal. In Example 8, the acid pasting step and the hydrochloric acid treatment step were not performed.

Example 9

An electrophotographic photosensitive member was produced in the same manner as in Example 8, except that 10 parts of the N,N-dimethylformamide used in the wet milling step was changed to 10 parts of dimethyl sulfoxide.

Example 10

An electrophotographic photosensitive member was produced in the same manner as in Example 1, except that the treatment time of the wet milling step was changed to 12 minutes.

Example 11

An electrophotographic photosensitive member was produced in the same manner as in Example 6, except that the treatment time of the wet milling step was changed to 1000 hours.

Example 12

An electrophotographic photosensitive member was produced in the same manner as in Example 8, except that the chlorogallium phthalocyanine produced in Synthesis Example 1 and used in the milling treatment that uses the paint shaker was changed to the chlorogallium phthalocyanine in Synthesis Example 2, and the treatment time of the wet milling step was changed to 500 hours.

In Examples 1 and 2 and Examples 4 to 12, the chlorogallium phthalocyanine crystal after the wet milling step is a mixture of a chlorogallium phthalocyanine in which all of $X_1$ to $X_4$ in the formula (1) represent hydrogen atoms and a chlorogallium phthalocyanine in which one of $X_1$ to $X_4$ in the formula (1) represents a chlorine atom as in the case of Example 3.

Comparative Example 1

An electrophotographic photosensitive member was produced in the same manner as in Example 12, except that the treatment time of the wet milling step was changed to 120 hours.

Comparative Example 2

An electrophotographic photosensitive member was produced in the same manner as in Comparative Example 1, except that the treatment time of the wet milling step was changed to 24 hours.

Comparative Example 3

An electrophotographic photosensitive member was produced in the same manner as in Comparative Example 1, except that 10 parts of the N,N-dimethylformamide used in the wet milling step was changed to 10 parts of dimethyl sulfoxide. The measured absorption spectrum had maximum absorption at 762 nm.

Comparative Example 4

An electrophotographic photosensitive member was produced in the same manner as in Comparative Example 3, except that the treatment time of the wet milling step was changed to 24 hours.

Comparative Example 5

An electrophotographic photosensitive member was produced in the same manner as in Comparative Example 1, except that the chlorogallium phthalocyanine produced in Synthesis Example 2 and used in the milling treatment that uses the paint shaker was changed to the chlorogallium phthalocyanine in Synthesis Example 3, and the treatment time of the wet milling step was changed to 168 hours.

Comparative Example 6

An electrophotographic photosensitive member was produced in the same manner as in Example 3, except that 10 parts of the N,N-dimethylformamide used in the wet milling step was changed to 10 parts of N,N-dimethylacetamide.

Comparative Example 7

An electrophotographic photosensitive member was produced in the same manner as in Example 3, except that 10 parts of the N,N-dimethylformamide used in the wet milling step was changed to 10 parts of benzyl alcohol.

Evaluation of Effect of Suppressing Ghosting

The effect of suppressing ghosting was evaluated for the electrophotographic photosensitive members produced in Examples and Comparative Examples in a normal-temperature and normal-humidity environment of 23° C./50%. The evaluation was performed using a converted printer of a laser beam printer (trade name: LaserJet Pro 400 Color M451dn) manufactured by Hewlett-Packard Company. The printer was converted such that the amount of exposure light (image exposure light) can be changed.

The produced electrophotographic photosensitive member was set in a process cartridge for cyan. A cartridge for development was removed from the device and a potential measuring instrument was inserted thereinto. This is set in a station of the process cartridge for cyan in the printer, and the amount of exposure light was adjusted so that the light-area potential (Vl) was −150 V. The potential measuring instrument included a potential probe (trade name: model 6000B-8, manufactured by TREK JAPAN) disposed at a development position of the cartridge for development. The potential probe was located at the center of the electrophotographic photosensitive member in a drum-axis direction. The potential at the center of the electrophotographic photosensitive member was measured with a surface electrometer (trade name: model 344, manufactured by TREK JAPAN).

Subsequently, the potential measuring instrument was removed, and the cartridge for development was reinstalled. The initial ghost image was evaluated.

Figure 7:
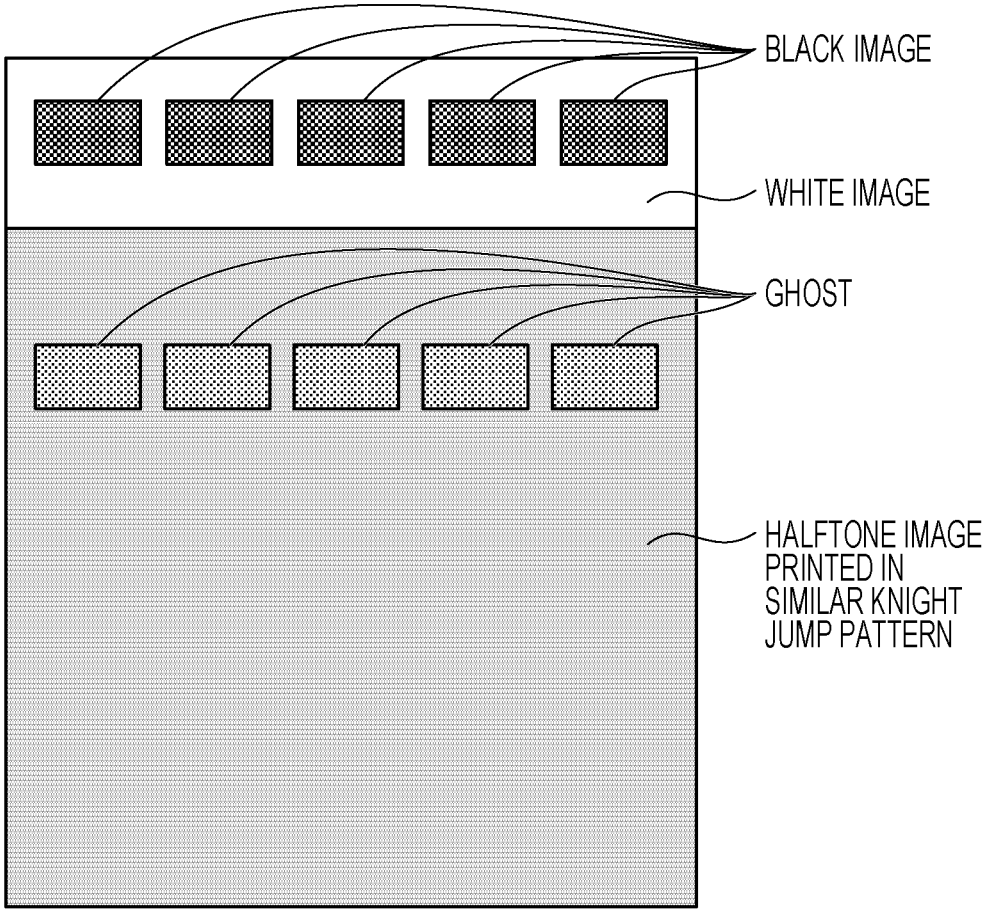
FIG. 7 illustrates an image for evaluation used in Examples.
Figure 8:
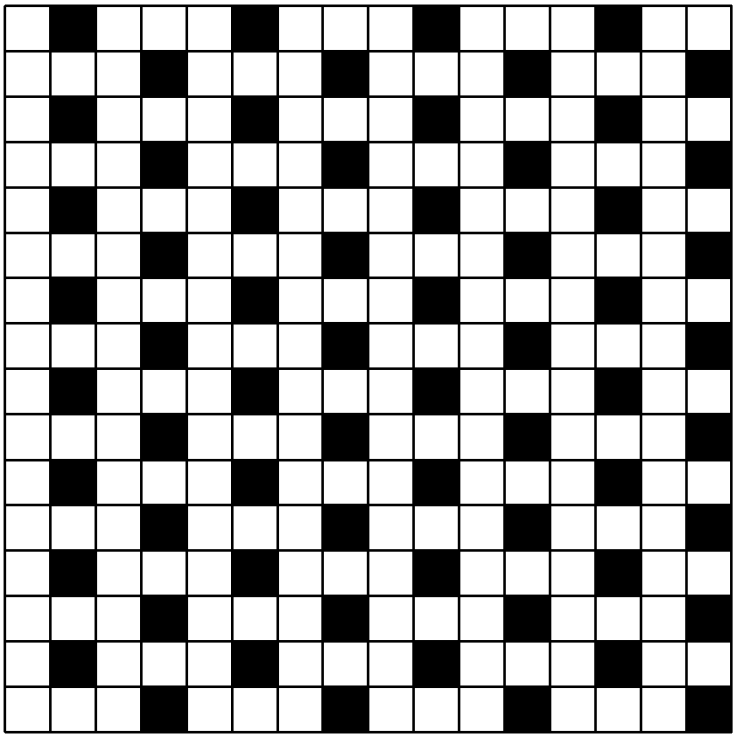
FIG. 8 illustrates an image of a similar knight jump pattern for forming a halftone image.

FIG. 7 illustrates an image for ghost evaluation. Quadrilateral black images were output in a white image at the top part of an image and then a halftone image was output. The halftone image was printed in a similar knight jump pattern illustrated in FIG. 8.

The ghost images were evaluated using a SpectroDensitometer (trade name: X-Rite 504/508 manufactured by X-Rite Inc.). On the output image, the Macbeth density of the halftone image of the similar knight jump pattern was subtracted from the Macbeth density of a ghost portion (a portion where a ghost may be generated), which was defined as a ghost image density difference. This evaluation was performed at ten points in a single output image, and the average of the ghost image density differences at the ten points was determined.

In this experiment, a ghost image density difference of less than 0.05 was a level at which the effects of the present invention were produced. Table 1 shows the results.

TABLE 1

Production conditions and evaluation results of crystal

| | Production conditions | | | | | Content (mass %) of organic | Evaluation result |
|---|---|---|---|---|---|---|---|
| | Synthesis | Acid | Hydrochloric | Wet milling treatment conditions | | compound relative to | Ghost image |
| Example No. | Example No. of crystal used | pasting treatment | acid treatment | Treatment time | Organic compound used | content of crystal | density difference |
| Example 1 | Synthesis Example 1 | Yes | Yes | 4 h | N,N-dimethylformamide | 0.59 | 0.014 |
| Example 2 | Synthesis Example 1 | Yes | Yes | 4 h | dimethyl sulfoxide | 0.63 | 0.015 |
| Example 3 | Synthesis Example 1 | Yes | Yes | 24 h | N,N-dimethylformamide | 0.58 | 0.018 |
| Example 4 | Synthesis Example 1 | Yes | Yes | 24 h | dimethyl sulfoxide | 0.60 | 0.019 |
| Example 5 | Synthesis Example 2 | Yes | Yes | 24 h | N,N-dimethylformamide | 0.51 | 0.024 |
| Example 6 | Synthesis Example 2 | Yes | Yes | 500 h | N,N-dimethylformamide | 0.45 | 0.026 |
| Example 7 | Synthesis Example 2 | Yes | Yes | 500 h | dimethyl sulfoxide | 0.49 | 0.028 |
| Example 8 | Synthesis Example 1 | No | No | 1000 h | N,N-dimethylformamide | 0.54 | 0.030 |
| Example 9 | Synthesis Example 1 | No | No | 1000 h | dimethyl sulfoxide | 0.57 | 0.031 |
| Example 10 | Synthesis Example 1 | Yes | Yes | 12 min | N,N-dimethylformamide | 0.27 | 0.037 |
| Example 11 | Synthesis Example 2 | Yes | Yes | 1000 h | N,N-dimethylformamide | 0.38 | 0.038 |
| Example 12 | Synthesis Example 2 | No | No | 500 h | N,N-dimethylformamide | 0.76 | 0.041 |
| Comparative Example 1 | Synthesis Example 2 | No | No | 120 h | N,N-dimethylformamide | 0.84 | 0.060 |
| Comparative Example 2 | Synthesis Example 2 | No | No | 24 h | N,N-dimethylformamide | 0.87 | 0.066 |

TABLE 1-continued

| Production conditions and evaluation results of crystal | | | | | | | |
|---|---|---|---|---|---|---|---|
| | Production conditions | | | | | Content (mass %) of organic compound relative to content of crystal | Evaluation result Ghost image density difference |
| | Synthesis | Acid | Hydrochloric | Wet milling treatment conditions | | | |
| Example No. | Example No. of crystal used | pasting treatment | acid treatment | Treatment time | Organic compound used | | |
| Comparative Example 3 | Synthesis Example 2 | No | No | 120 h | dimethyl sulfoxide | 0.96 | 0.062 |
| Comparative Example 4 | Synthesis Example 2 | No | No | 24 h | dimethyl sulfoxide | 1.07 | 0.067 |
| Comparative Example 5 | Synthesis Example 3 | No | No | 168 h | N,N-dimethylformamide | — | 0.081 |
| Comparative Example 6 | Synthesis Example 1 | Yes | Yes | 24 h | N,N-dimethylacetamide | — | 0.065 |
| Comparative Example 7 | Synthesis Example 1 | Yes | Yes | 24 h | benzyl alcohol | — | 0.063 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-220749, filed Oct. 29, 2014, which is hereby incorporated by reference herein in its entirety.

What is claimed is:

1. A method for producing a chlorogallium phthalocyanine crystal represented by formula (1) in which at least one organic compound selected from N,N-dimethylformamide and dimethyl sulfoxide is comprised, the method comprising:

a synthesis step of synthesizing a chlorogallium phthalocyanine crystal by reacting a gallium compound and a compound that forms a phthalocyanine ring in a chlorinating aromatic compound;

an acid pasting step of obtaining a hydroxygallium phthalocyanine crystal by performing an acid pasting treatment in which the chlorogallium phthalocyanine crystal obtained in the synthesis step is mixed with sulfuric acid;

a hydrochloric acid treatment step of obtaining a chlorogallium phthalocyanine crystal by mixing the hydroxygallium phthalocyanine crystal obtained in the acid pasting step with an aqueous hydrochloric acid solution; and a wet milling step of obtaining a chlorogallium phthalocyanine crystal by mixing the chlorogallium phthalocyanine crystal obtained in the hydrochloric acid treatment step with at least one organic compound selected from N,N-dimethylformamide and dimethyl sulfoxide and performing a wet milling treatment, wherein a content of the organic compound comprised in the chlorogallium phthalocyanine crystal represented by the formula (1) is 0.10 mass % or more and 0.80 mass % or less based on a content of the chlorogallium phthalocyanine crystal represented by the formula (1), (1)

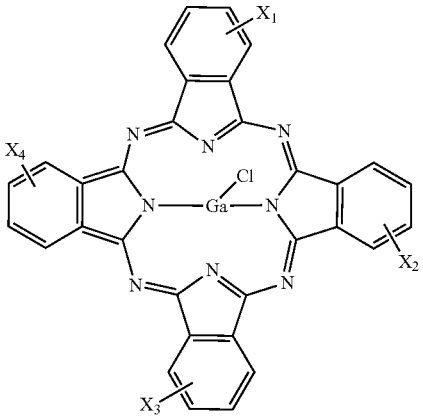

where $X_1$ to $X_4$ each independently represent a hydrogen atom or a chlorine atom.

2. The method for producing a chlorogallium phthalocyanine crystal according to claim 1, wherein the gallium compound is gallium trichloride.

3. The method for producing a chlorogallium phthalocyanine crystal according to claim 1, wherein the compound that forms a phthalocyanine ring is orthophthalonitrile and the chlorinating aromatic compound is α-chloronaphthalene.

4. The method for producing a chlorogallium phthalocyanine crystal according to claim 1, wherein a concentration of the aqueous hydrochloric acid solution used in the hydrochloric acid treatment step is 10 mass % or more, and an amount of hydrochloric acid in the aqueous hydrochloric acid solution used is 10 mol or more based on 1 mol of the hydroxygallium phthalocyanine used.

5. A method for producing an electrophotographic photosensitive member comprising:

a support;

a charge generating layer; and a charge transporting layer in this order, the method comprising:

preparing an application liquid for the charge generating layer; and forming a coating film of the application liquid for the charge generating layer, followed by drying the coating film, to thereby form the charge generating layer, and wherein the application liquid containing a chlorogallium phthalocyanine crystal being produced by the method according to claim 1.

* * * * *